US009381714B2

(12) United States Patent
Koike

(10) Patent No.: US 9,381,714 B2
(45) Date of Patent: Jul. 5, 2016

(54) ADHESIVE LABEL PRODUCTION DEVICE

(71) Applicant: SEIKO EPSON CORPORATION, Tokyo (JP)

(72) Inventor: Yoshimitsu Koike, Suwa (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 14/374,527

(22) PCT Filed: Apr. 30, 2013

(86) PCT No.: PCT/JP2013/002894

§ 371 (c)(1),
(2) Date: Jul. 25, 2014

(87) PCT Pub. No.: WO2013/168394

PCT Pub. Date: Nov. 14, 2013

(65) Prior Publication Data

US 2014/0373775 A1 Dec. 25, 2014

(30) Foreign Application Priority Data

May 9, 2012 (JP) ..... 2012-107355

(51) Int. Cl.
*B05B 7/06* (2006.01)
*B05C 11/00* (2006.01)
*B31D 1/02* (2006.01)
(Continued)

(52) U.S. Cl.
CPC ..... *B31D 1/027* (2013.01); *B31D 1/026* (2013.01); *B41J 3/4075* (2013.01); *B65C 11/0289* (2013.01); *B65C 11/04* (2013.01); *B65H 35/0006* (2013.01); *B65H 35/06* (2013.01); *G09F 3/10* (2013.01); *B41J 11/703* (2013.01);
(Continued)

(58) Field of Classification Search
USPC ..... 118/313–315, 35–43, 46; 156/351, 353, 156/358, 384, 387, 581
See application file for complete search history.

(56) References Cited

U.S. PATENT DOCUMENTS 4,108,710 A * 8/1978 Hoffmann ..... 156/450
4,544,431 A * 10/1985 King ..... B65C 3/16 156/256
(Continued)

FOREIGN PATENT DOCUMENTS

JP 56142135 A 11/1981
JP 200389247 A 3/2003
(Continued)

OTHER PUBLICATIONS

International Search Report and Written Opinion mailed Aug. 13, 2013, corresponds to PCT/JP2013/002894.

*Primary Examiner* — Yewebdar Tadesse
(74) *Attorney, Agent, or Firm* — Hauptman Ham, LLP

(57) ABSTRACT

An adhesive label production device has an ejection mechanism that is easy to maintain.
A printer 100 used as an adhesive label production device has a conveyance mechanism 8 that conveys continuous recording paper (recording medium) P; a recording head 5 that prints on the recording paper P conveyed by the conveyance mechanism 8; an automatic cutter 4 that cuts the recording paper P; and an inkjet head (ejection mechanism) 15 that ejects adhesive 18 onto the recording paper P that was cut by the automatic cutter 4. The inkjet head 15 has a plurality of nozzles (ejection holes), and ejection by each of the nozzles can be individually controlled.

7 Claims, 6 Drawing Sheets

(51) Int. Cl.

| | |
|---|---|
| ***B41J 3/407*** | (2006.01) |
| ***B65C 11/02*** | (2006.01) |
| ***B65C 11/04*** | (2006.01) |
| ***G09F 3/10*** | (2006.01) |
| ***B65H 35/00*** | (2006.01) |
| ***B65H 35/06*** | (2006.01) |
| *B41J 11/70* | (2006.01) |

(52) U.S. Cl.
CPC ... *B65C 2210/007* (2013.01); *B65C 2210/0059* (2013.01); *B65H 2701/192* (2013.01)

(56) References Cited

U.S. PATENT DOCUMENTS

| | | | | |
|---|---|---|---|---|
| 7,771,556 | B2 * | 8/2010 | Fort | B65C 9/2208 156/256 |
| 2002/0168212 | A1 * | 11/2002 | Nedblake et al. | 400/621 |
| 2004/0036922 | A1 | 2/2004 | Yamada et al. | |
| 2005/0036090 | A1 | 2/2005 | Hayashi et al. | |
| 2007/0190253 | A1 | 8/2007 | Matsunaga | |
| 2008/0079871 | A1 * | 4/2008 | Hong | B32B 27/08 349/96 |
| 2009/0185291 | A1 | 7/2009 | Tsuchiya et al. | |
| 2011/0277905 | A1 | 11/2011 | Koike | |
| 2011/0300289 | A1 * | 12/2011 | Suzuki | H01L 51/0005 427/8 |

FOREIGN PATENT DOCUMENTS

| | | | |
|---|---|---|---|
| JP | 2003243160 | A | 8/2003 |
| JP | 200430941 | A | 1/2004 |
| JP | 200435043 | A | 2/2004 |
| JP | 200477930 | A | 3/2004 |
| JP | 2004351413 | A | 12/2004 |
| JP | 200983315 | A | 4/2009 |
| JP | 2009175331 | A | 8/2009 |
| JP | 2011235595 | A | 11/2011 |

* cited by examiner

ADHESIVE LABEL PRODUCTION DEVICE

RELATED APPLICATIONS

The present application is a National Phase of International Application Number PCT/JP2013/002894, filed Apr. 30, 2013, which claims priority to Japanese Application Number 2012-107355, filed May 9, 2012.

TECHNICAL FIELD

The present invention relates to an adhesive label production device that can produce adhesive labels to which printing and an adhesive are applied.

BACKGROUND

Label paper having labels with an adhesive surface affixed to a continuous release paper liner is conventionally used to produce adhesive labels. However, because the liner portion of label paper with a liner backing becomes waste, so-called linerless label stock that does not use a liner that is then thrown away is now also available. A printer that produces linerless label paper is taught in PTL 1, and this printer is configured to produce adhesive labels by printing on the front side of label paper that was previously coated with adhesive on the back side and then cutting the printed portion.

Another type of linerless label paper is coated on the back side with a heat-sensitive adhesive layer that becomes adhesive when activated by heat. PTL 2 teaches a printer that prints on this type of heat-activated label paper (delayed-tack paper), and applies heat with a heater to activate the adhesive after cutting the paper with an automatic cutter.

CITATION LIST

Patent Literature

[PTL 1] JP-A-2003-089247
[PTL 2] JP-A-2004-035043

SUMMARY OF INVENTION

Technical Problem

The label paper used in PTL 1 in the technology according to the related art is wound into a roll for easily loading into the printer with the adhesive surface on the back exposed. As a result, the printing surface on the front is coated with a release agent for easy separation so that the label paper can be easily pulled from the roll. However, when label paper pulled off the roll is set in the paper path inside the printer and then printed while being conveyed, the release agent may separate from the printing surface and built up on the printhead, possibly creating problems with printing. Paper jams can also result from the adhesive sticking to the printhead, the paper conveyance path, or the cutter for cutting the label paper. To prevent these problems, an anti-stickiness treatment must be applied to the printhead, paper conveyance path, paper cutter, and other parts, or an adhesive removal mechanism must be provided. Alternatively, regular maintenance is required to remove the accumulated adhesive or the accumulated release agent. Printer maintenance therefore becomes more difficult.

When adhesion is activated after cutting the label paper using heat-activated label paper as described in PTL 2, a large heating mechanism and power supply for applying heat must be provided inside the printer. The printer therefore becomes larger and more expensive.

Linerless label paper such as described in PTL 1 and PTL 2 eliminates the liner but requires previously coating with an adhesive or forming a heat-activated adhesive layer, and is therefore more expensive than plain paper. Furthermore, because the adhesive or heat-activated adhesive layer is applied to the entire back side of the label paper, the adhesive or heat-activated adhesive layer is wastefully applied when the adhesive or heat-activated adhesive layer could be simply applied to specific areas. Other problems with the adhesive labels described in PTL 1 and PTL 2 include a production cost that is higher than necessary and little versatility because where the adhesive or heat-activated adhesive layer is applied is restricted.

Solution to Problem

The present invention is directed to solving at least part of the foregoing problem, and can be accomplished as described in the following examples and embodiments.

Example 1

An adhesive label production device according to this example includes a conveyance mechanism that conveys a continuous recording medium; a recording head that prints on the recording medium conveyed by the conveyance mechanism; and an ejection mechanism that ejects adhesive onto a recording medium after printing by the recording head, and is characterized by the ejection mechanism including a plurality of ejection holes and able to individually control ejection from each of the ejection holes.

The adhesive label production device in this example is configured to eject adhesive by the ejection mechanism onto the recording medium after printing by the recording head, and does not require using expensive recording media that has already been coated with an adhesive or heat-activated adhesive layer. Because adhesive does not stick and release agent does not build up on the recording head and conveyance mechanism, for example, in the adhesive label production device, regular maintenance is easier, a mechanism and power supply for heating a heat-activated adhesive layer are not needed, device cost can be reduced, and device size can be reduced. The adhesive label production device also uses an ejection mechanism with plural ejection nozzles for ejecting adhesive, individually controls ejection of adhesive from each of the nozzles, and can freely and selectively apply or not apply adhesive to the recording medium. In addition to adhesive labels to which adhesive is applied, the adhesive label production device can therefore also selectively produce non-adhesive labels with no adhesive applied.

Example 2

The adhesive label production device in the above example preferably also has an automatic cutter that cuts the recording medium; and the ejection mechanism ejects adhesive onto the recording medium after cutting by the automatic cutter.

Because the adhesive label production device ejects adhesive onto the recording medium after the recording medium is cut by the automatic cutter in this configuration, the adhesive label production device can produce adhesive labels with printing and adhesive using inexpensive plain paper as the recording medium.

Note that the recording medium in this adhesive label production device is typically conveyed by the conveyance mechanism sequentially past the recording head, automatic cutter, and then the ejection mechanism.

Example 3

In the adhesive label production device described above, the ejection mechanism is preferably an inkjet type ejection mechanism.

By using an inkjet-style ejection mechanism to eject the adhesive in this configuration, the adhesive label production device can more easily and reliably control ejection based on the properties of the adhesive, and control selection of the ejection holes that eject the adhesive, when ejecting adhesive from the ejection holes. As a result, the adhesive label production device can quickly change the selection and efficiently produce adhesive labels and non-adhesive labels.

Example 4

In the adhesive label production device described above, the ejection mechanism can preferably eject the adhesive in a desired pattern on the opposite side of the recording medium as the side that was printed.

In this configuration, the recording medium is printed on one side and has adhesive applied to the other side. The adhesive is ejected in a desired pattern by the ejection mechanism on this other side. A desired pattern as used here includes a wide variety of patterns such as ejecting adhesive to cover the entire surface of the recording medium, ejecting adhesive only around the edges of the recording medium, ejecting adhesive in dots at plural places on the recording medium, and not ejecting adhesive, and means applying adhesive in any pattern on the recording medium. This can be achieved by using an inkjet-type ejection mechanism, for example, that can freely and easily control ejection of adhesive onto the conveyed recording medium. As a result, the adhesive label production device can selectively control where the adhesive is applied each time recording media is printed, and can easily apply adhesive in a pattern enabling easy removal of the label by not applying adhesive in specific parts, or apply adhesive in a pattern matching the shape of the item to which the adhesive label will be applied, for example.

Example 5

In the adhesive label production device described above, the ejection mechanism preferably ejects a plurality of functional fluids that when mixed exhibit the same adhesion as the adhesive.

In this configuration, the ejection mechanism of the adhesive label production device has a configuration that ejects plural functional fluids, and sequentially ejects the functional fluids so that one is deposited over another. When plural functional fluids are ejected so that one covers the other on the recording medium, the functional fluids mix together on the recording medium, and the mixture becomes adhesive. Because the adhesive label production device using this ejection mechanism can eject functional fluids that are not adhesive, ejection by the ejection mechanism and control are easier than when ejecting adhesive that is adhesive. In addition, even if the functional fluids that are not adhesive stick to the ejection mechanism or the conveyance mechanism, the effect of the remnant fluids is less than an adhesive, and can be easily removed. Yet further, because the adhesive label production device uses non-adhesive functional fluids, the ejection mechanism can be easily cleaned by wiping, and maintenance is simplified.

Example 6

Further preferably, the adhesive label production device described above has plural ejection mechanisms, and each ejection mechanism ejects one of plural functional fluids.

In this configuration the adhesive label production device is configured with the same number of ejection mechanisms as functional fluids and each of the ejection mechanisms ejects one of the functional fluids. Because one ejection mechanism ejects only one functional fluid, control of each ejection mechanism is simpler than in a configuration in which a single ejection mechanism ejects plural functional fluids. When wiping the ejection mechanism, different functional fluids are not mixed by the wiping, and maintenance is therefore even easier. Furthermore, because the ejection mechanisms can be individually replaced for each functional fluid, adjusting fluid ejection is simple and efficient.

Example 7

Further preferably in the adhesive label production device described above, both printing and application of adhesive are applied to one side of the recording medium.

In this configuration, the adhesive label production device prints on one side of the recording medium, and then ejects and applies adhesive to the same side as the side that was printed. Because printing and application of adhesive are done on the same side of the recording medium with this adhesive label production device, the printed surface is located between the adhesive label and the item when the produced adhesive label is applied to an item. As a result, when the labelled item is transparent, or the recording medium is transparent, the printed content can be seen, and the printing can be reliably prevented from disappearing as a result of scratching or rubbing.

Example 8

Further preferably in the adhesive label production device described above, in addition to the ability to eject adhesive, the ejection mechanism also has the ability to print on the recording medium instead of the printhead, and is disposed facing the one side of the recording medium.

In addition to the ability to eject adhesive, the ejection mechanism of the adhesive label production device in this configuration can also function as a recording head that prints. In this event, the ejection mechanism could be configured to eject ink to print and then eject adhesive to cover the ink, or to eject an adhesive printing ink, or to eject a colored adhesive. The adhesive label production device thus comprised can accomplish the functions of both a recording head that prints on the recording medium, and an ejection mechanism that ejects adhesive, using a single ejection mechanism. As a result, the adhesive label production device can be configured from an automatic cutter and an ejection mechanism, the conveyance mechanism can be simplified, and the size can be reduced. Note that because an inkjet ejection mechanism, for example, functions as a recording head in the adhesive label production device according to this configuration, the recording medium conveyed by the conveyance mechanism is conveyed sequentially from the automatic cutter to the ejection mechanism.

DESCRIPTION OF EMBODIMENTS

A preferred embodiment of an adhesive label production device according to the invention is described below with reference to the accompanying figures. A printer with an inkjet head (discharge mechanism) that ejects adhesive is described as an example of an adhesive label production device below.

Embodiment 1

Figure 1:
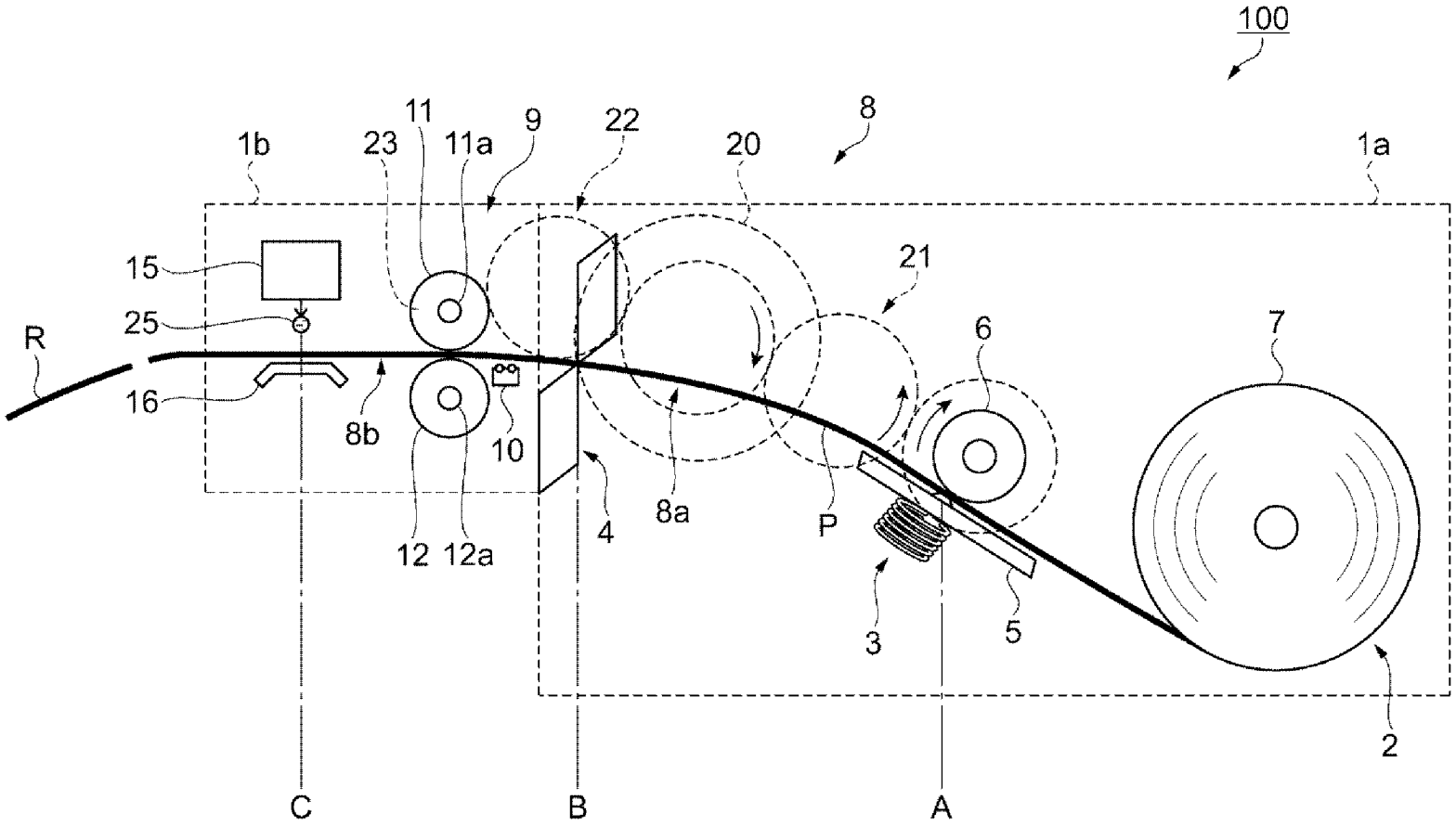
FIG. 1 is a section view illustrating the configuration of a printer according to a first embodiment of the invention.
Figure 2:
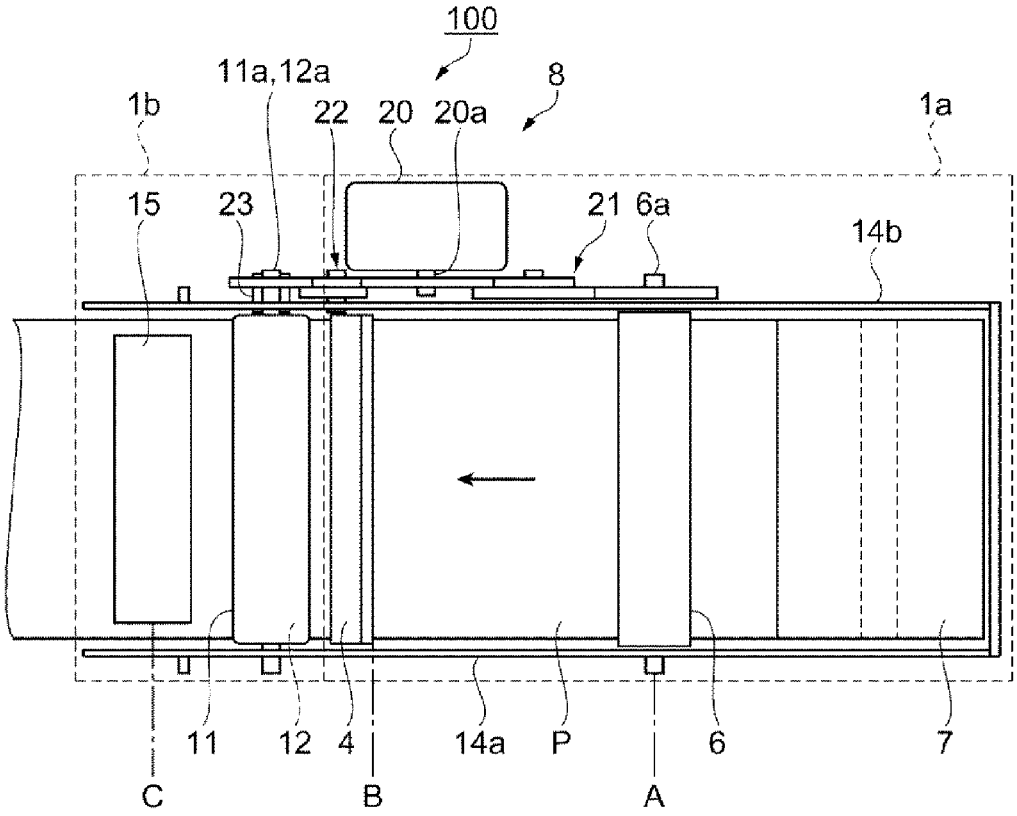
FIG. 2 is a plan view illustrating the configuration of the printer.

FIG. 1 is a section view showing the configuration of a printer according to the first embodiment of the invention. FIG. 2 is a plan view showing the configuration of the printer. As shown in FIG. 1 and FIG. 2, the printer (adhesive label production device) 100 includes a print unit 1*a* and an adhesive application unit 1*b* disposed on the downstream side of the print unit 1*a* in the printer 100.

The print unit 1*a* has a roll paper compartment 2, print mechanism 3, and automatic cutter 4. The roll paper compartment 2 stores a paper roll 7 of continuous recording paper (recording medium) P wound into a roll. The print mechanism 3 includes a recording head 5 that prints on the recording paper P, and a platen roller 6 disposed opposite the recording head 5 with the recording paper P held therebetween. The printer 100 uses so-called plain paper as the recording paper P for printing receipts using a thermal head as the recording head 5, for example.

The printer 100 also has a conveyance mechanism 8 for pulling and conveying the recording paper P from the paper roll 7 in the roll paper compartment 2 to the recording head 5, automatic cutter 4, and adhesive application unit 1*b*. The conveyance mechanism 8 has a conveyance path 8*a* for conveying the recording paper P pulled from the paper roll 7 in the roll paper compartment 2 past the print position A defined by the recording head 5 and the platen roller 6 to the automatic cutter 4, and a conveyance path 8*b* in the adhesive application unit 1*b* for conveying the recording paper P cut by the automatic cutter 4. When the platen roller 6 turns in conjunction with the conveyance mechanism 8, the recording paper P is conveyed from the paper roll 7 toward the print position A. If the recording head 5 is driven in conjunction with this conveyance operation, specific content is printed on one side of the recording paper P (the underside as seen in FIG. 1). The portion of the recording paper P that was printed is then conveyed to the cutting position B, cut by the automatic cutter 4, and then conveyed to the adhesive application unit 1*b*.

The automatic cutter 4 is disposed at the junction between the print unit 1*a* and adhesive application unit 1*b*, and cuts the printed recording paper P. The recording paper P is thus conveyed through the conveyance path 8*a* in the print unit 1*a*, printed and cut, and then conveyed through the conveyance path 8*b* in the adhesive application unit 1*b* that communicates with the conveyance path 8*a*.

The adhesive application unit 1*b* includes an adhesive application mechanism 9 that applies adhesive to the recording paper P conveyed through the conveyance path 8*b*, and a paper detection sensor 10 that detects the presence of recording paper P on the upstream side (the automatic cutter 4 side) of the adhesive application position C of the adhesive application mechanism 9. The adhesive application unit 1*b* includes a drive roller 11 for conveying the recording paper P in conjunction with rotation of the platen roller 6 on the print unit 1*a* side, and a driven roller 12 that rotates in conjunction with the drive roller 11 and holds the recording paper P therebetween, and the drive roller 11 and driven roller 12 together convey the recording paper P through the conveyance path 8*b*.

The adhesive application mechanism 9 has an inkjet head (ejection mechanism) 15 that ejects adhesive onto the recording paper P on the other side (the top side as seen in FIG. 1) of the recording paper P at the adhesive application position C, and a flat platen 16 disposed on the print surface side of the recording paper P opposite the inkjet head 15 for guiding the recording paper P. The inkjet head 15 has a plurality of nozzles (ejection nozzles) for ejecting droplets 25 of adhesive, and where adhesive is applied to the recording paper P can be freely controlled by selecting which nozzles eject the droplets 25 and controlling the ejection timing from the nozzles according to conveyance of the recording paper P. More specifically, the inkjet head 15 can deposit adhesive in a desired pattern on the recording paper P.

The conveyance mechanism 8 supports the spindle 6*a* of the platen roller 6 freely rotatably between the left and right side frames 14*a*, 14*b* of the printer 100 in the print unit 1*a*, and has a paper feed motor 20 on the opposite side of side frame 14*b* as the platen roller 6, that is, on the outside side. A transfer gear train 21 for transferring rotation of the output shaft 20*a* to the spindle 6*a* at a specific speed reduction ratio is disposed between the output shaft 20*a* (FIG. 2) of the paper feed motor 20 and the spindle 6*a* protruding to the paper feed motor 20 side.

One end of the rotating shaft 11*a* of the drive roller 11 protrudes to the outside of the side frame 14*b* like the spindle 6*a*, and a transfer gear train 22 that transfers rotation of the output shaft 20*a* at a specific gear reduction ratio to the rotating shaft 11*a*, and an electromagnetic clutch 23 between the output gear of the transfer gear train 22 and the rotating shaft 11*a*, are disposed between this rotating shaft 11*a* and the output shaft 20*a* of the paper feed motor 20. The driven roller 12 is mounted freely rotatably on a rotating shaft 12*a* between the side frames 14*a*, 14*b*.

The electromagnetic clutch 23 is provided for engaging and disengaging the output gear with the rotating shaft 11*a*, and when disengaged, rotation of the output gear of the transfer gear train 22 is not transferred to the rotating shaft 11*a*. More specifically, when the electromagnetic clutch 23 is disengaged and the paper feed motor 20 is driven, only the platen roller 6 turns and the drive roller 11 does not turn. Because rotation of the output gear of the transfer gear train 22 is transferred to the rotating shaft 11*a* when the electromagnetic clutch 23 is engaged, the platen roller 6 and drive roller 11 rotate together when the paper feed motor 20 is driven with the electromagnetic clutch 23 engaged, and the recording paper P is conveyed through both conveyance path 8*a* and conveyance path 8*b*. After printing, cutting, and application of adhesive, the recording paper P is removed by the user as an adhesive label R from the printer 100.

Figure 3:
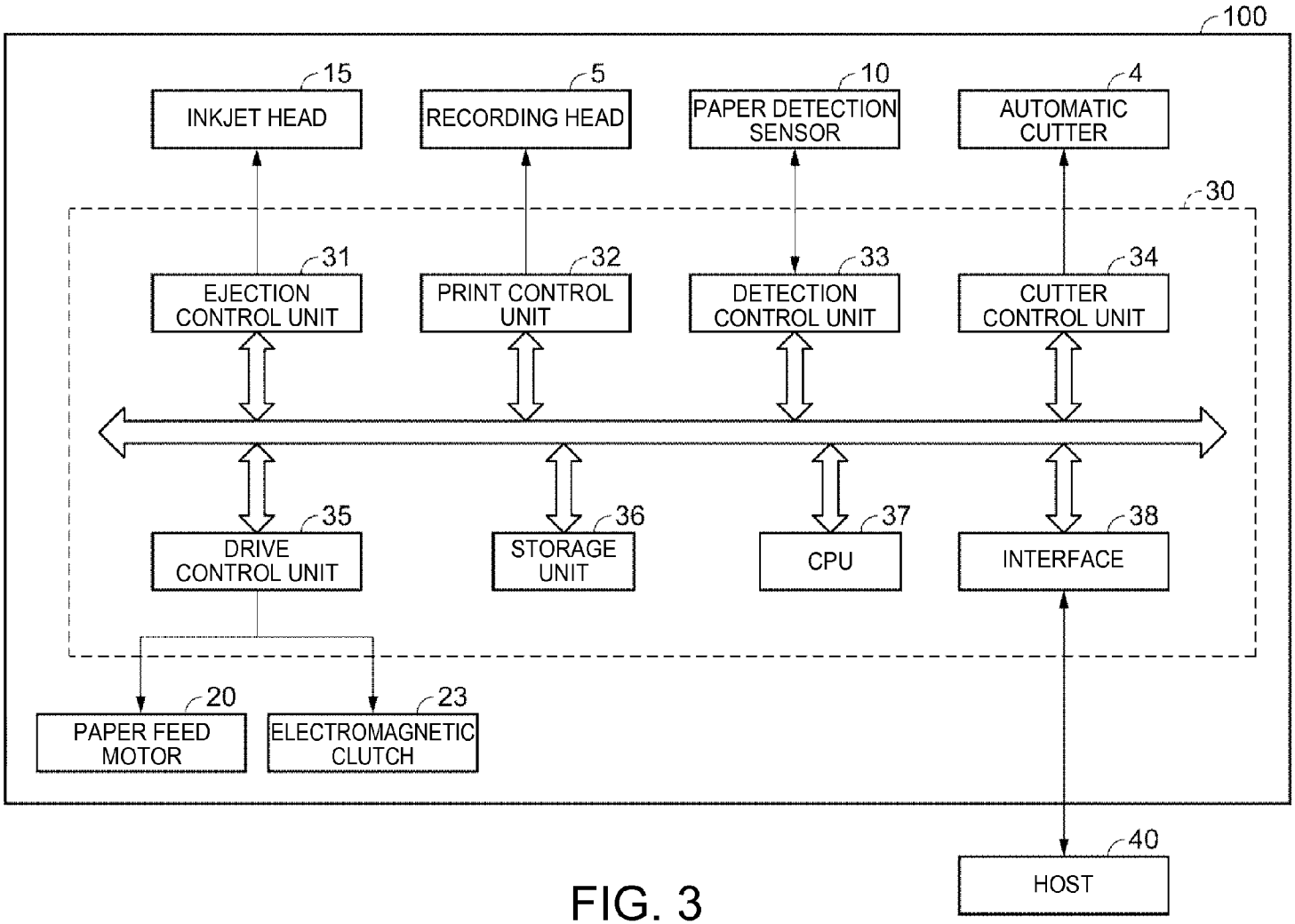
FIG. 3 is a block diagram illustrating the configuration of the control unit of the printer.
Figure 4A:
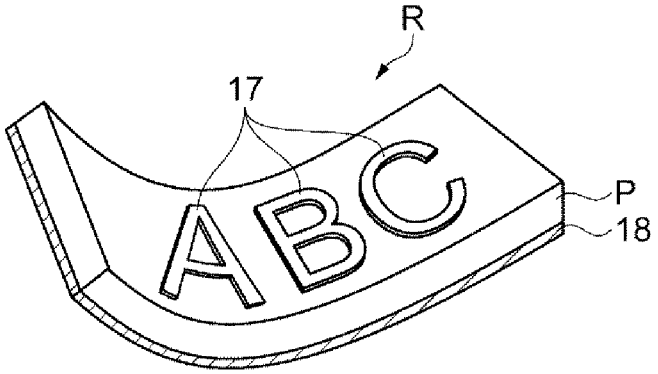
FIG. 4 (*a*) is an oblique view of an adhesive label according to the first embodiment of the invention, and (b) to (d) are plan views showing other examples of applying the adhesive to an adhesive label.
Figure 4B:
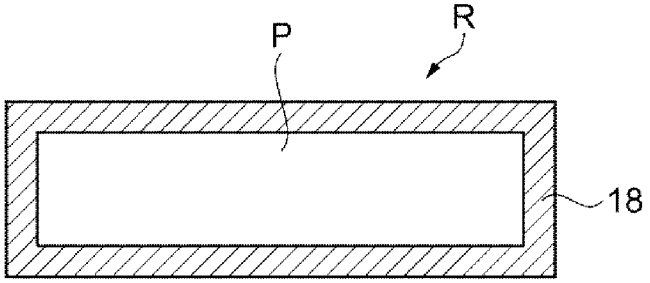
Figure 4C:
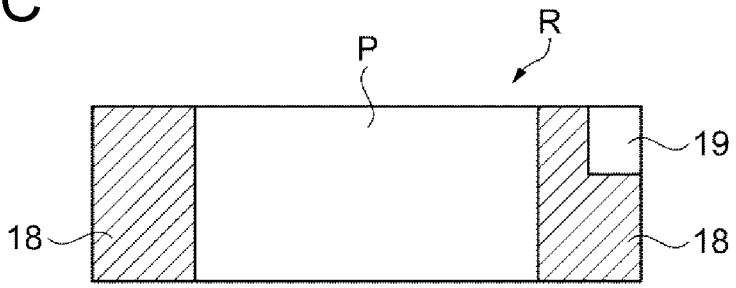
Figure 4D:
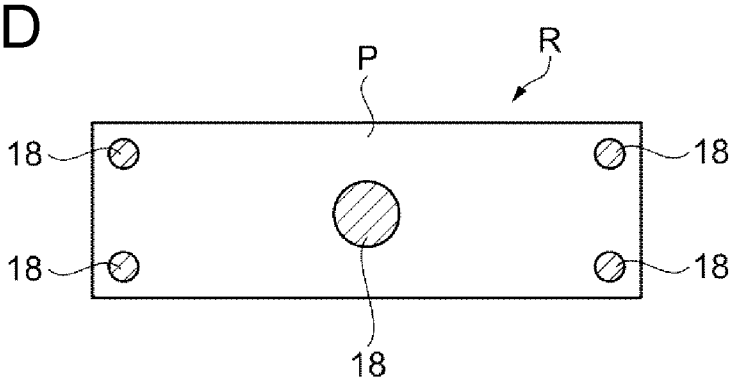

The control unit of the printer 100 is described next. FIG. 3 is a block diagram showing the configuration of the printer control unit. The control unit 30 of the printer 100 includes a storage unit 36 composed of ROM and RAM that store information such as firmware and data, an interface 38 for connecting to an external host 40 and receiving information including print data and commands, and a CPU 37 that controls the printer 100 based on the foregoing information. The control unit 30 also has a drive control unit 35 for controlling the paper feed motor 20 and electromagnetic clutch 23 that convey the recording paper P; a print control unit 32 for controlling the recording head 5 that prints on the recording paper P; a cutter control unit 34 for controlling operation of the automatic cutter 4 based on the timing of the position where the recording paper P is to be cut passing the cutting position B; a detection control unit 33 for controlling the paper detection sensor 10 that detects if there is recording paper P in the adhesive application unit 1*b*; and an ejection control unit 31 for controlling the inkjet head 15 that ejects adhesive from the nozzles onto the recording paper P. The CPU 37 controls operation of these control units so that the recording paper P is appropriately printed and coated with adhesive.

When a printer 100 with this control configuration receives print data from the host 40 through the interface 38, the electromagnetic clutch 23 is engaged by a command from the drive control unit 35, driving the paper feed motor 20 then starts, and the platen roller 6 rotates in the forward conveyance direction and conveys the recording paper P downstream in the print unit 1*a*. When the print area on the recording paper P reaches the print position A, the recording head 5 prints on the recording paper P as instructed by the print control unit 32.

When printing the content specified in the print data ends, the printer 100 stops driving the recording head 5. Next, the printer 100 conveys the recording paper P until the cutting position of the recording paper P is set to the cutting position B of the automatic cutter 4, and then stops conveying the recording paper P. Rotation of the platen roller 6 and drive roller 11 thus stops. Adhesive is applied to the recording paper P in the adhesive application unit 1*b* until conveyance of the recording paper P stops. The printer 100 then cuts the recording paper P and enters the print standby state, or reverses the recording paper P to the print position of the recording head 5 in order to index the paper to start the next print job. Because the paper is reversed with the electromagnetic clutch 23 disengaged, the portion of the recording paper P to which adhesive was already applied is not reversed.

Note that the control unit 30 could execute the paper cutting process and reversing process only when appropriate commands for executing these processes are received. The reversing process can also be omitted when the paper cutting process is not executed. In this event, the uncut portion of the recording paper P to which adhesive was applied is not reversed, and paper jams, for example, can be prevented.

As described above, the printed recording paper P is conveyed by rotation of the platen roller 6 and drive roller 11, and adhesive is ejected from the inkjet head 15 as controlled by the ejection control unit 31 to the portion of the recording paper P passing the adhesive application position C, until the paper feed motor 20 stops. The recording paper P is then held by the adhesive application mechanism 9 because the electromagnetic clutch 23 disengages after cutting by the automatic cutter 4. The adhesive label R with specifically applied adhesive will therefore not fall out of the printer 100 before being taken by the user. This is so that the user that produced the adhesive label R can manually remove the cut recording paper P from the printer 100 when desired after the recording paper P is cut by the automatic cutter 4.

More specifically, because the recording paper P remains between the cutting position B and the adhesive application position C until the user manually removes the recording paper P after the recording paper P is cut by the automatic cutter 4, the paper detection sensor 10 of the printer 100 continues to output the paper-present signal. The printer 100 therefore remains able to eject adhesive by the inkjet head 15 at any time until the output of the paper detection sensor 10 changes to the no-paper state.

If the user manually removes the recording paper P while the paper detection sensor 10 is outputting the paper-present signal, the trailing end of the recording paper P on the upstream side of the adhesive application position C passes the adhesive application position C. The inkjet head 15 senses passage of the recording paper P, and ejects and applies adhesive to the trailing end part of the recording paper P. As a result, the recording paper P pulled out by the user has adhesive applied all the way from the leading end to the trailing end, and can be used as an adhesive label R. Note that because the electromagnetic clutch 23 is disengaged and the drive roller 11 and driven roller 12 rotate in conjunction with manual removal of the recording paper P during this manual removal operation, the drive roller 11 and driven roller 12 do not interfere with manual removal of the adhesive label R. The printer 100 can therefore print and apply adhesive to recording paper P, and easily and reliably produce adhesive labels R.

Because adhesive does not stick and release agent does not accumulate on the recording head, automatic cutter, and conveyance mechanism in the printer 100 thus comprised as they do in a conventional printer, regular maintenance is easier, a mechanism and power supply for heating a heat-activated adhesive layer are not needed, device cost can be reduced, and device size can be reduced.

An example of a adhesive label R produced by the printer 100 is described next. FIG. 4 (*a*) is an oblique view showing the appearance of an adhesive label according to the first embodiment of the invention, and FIG. 4 (*b*) to (*d*) are plan views showing examples of how adhesive may be applied to an adhesive label.

First, as shown in FIG. 4 (*a*), an adhesive label R has text 17 that is printed by the recording head 5 on one side of the recording paper P, which is plain paper for printing receipts, for example, and adhesive 18 that is applied by the inkjet head 15 on the opposite side of the recording paper P as the text 17 side. In this example the text 17 is the string ABC. The adhesive label R is used with the adhesive 18 side affixed to an item so that the text 17 string ABC can be read after the label is applied.

As shown in FIG. 4 (*b*) to (*d*), the adhesive 18 applied to the adhesive label R is ejected from the inkjet head 15 to form variously shaped areas depending upon the shape of the item to be labelled or how the label is affixed, for example. In one pattern as shown in FIG. 4 (*a*), for example, the adhesive 18 is applied over the entire surface of the adhesive label R. In another pattern as shown in FIG. 4 (*b*), the adhesive 18 is applied along the edges of the adhesive label R, and adhesive 18 is not applied in the middle portion surrounded by the edge areas. With this pattern the adhesive 18 is only applied to the edge areas that can peel easily, and consumption of adhesive 18 can be reduced. In another pattern as shown in FIG. 4 (*c*), the adhesive 18 is applied only at the leading end and trailing end of the adhesive label R, and adhesive 18 is not applied in one corner of the trailing end of the adhesive label R. The corner where the adhesive 18 is not applied can be used as a peeling tab 19 to easily start peeling in order to remove the adhesive label R after it is affixed. In another pattern as shown in FIG. 4 (*d*), the adhesive 18 is applied in round dots only in the four corners and the center of the adhesive label R. This pattern enables affixing the adhesive label R with adhesive 18 only in the specific places that can be affixed to the labelled item, and does not waste adhesive 18. Note that while not shown in the figure, the adhesive label R could also be a ticket to which adhesive 18 is not applied.

By using an inkjet head 15 in the adhesive application mechanism 9 as described above, the printer 100 can eject adhesive 18 to form variously shaped areas when applying adhesive 18 to an adhesive label R. More specifically, forming variously shaped adhesive 18 areas means that adhesive areas can be formed in any desired pattern, including patterns in which no adhesive 18 is applied, and many different patterns are possible in addition to the adhesive 18 patterns shown in the figures.

Embodiment 2

Figure 5A:
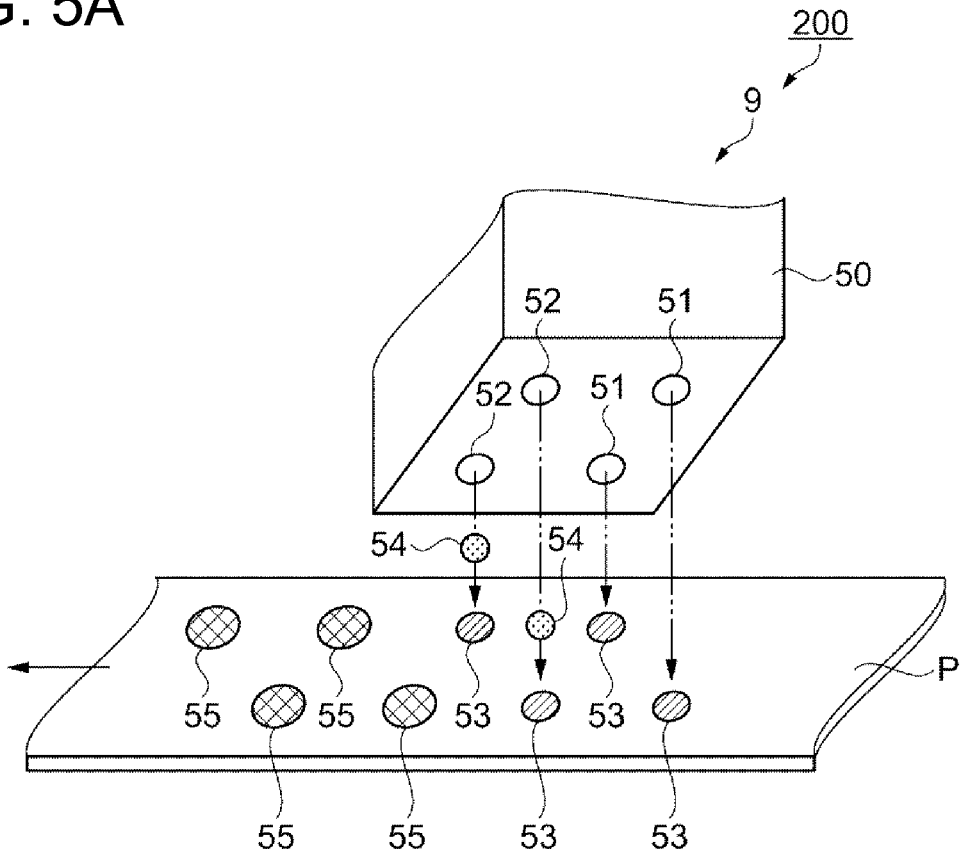
FIG. 5 (*a*) is a section view illustrating an example of the adhesive application method using the inkjet head of a printer according to a second embodiment of the invention, and (b) is a section view illustrating another example of a method of applying adhesive with an inkjet head.
Figure 5B:
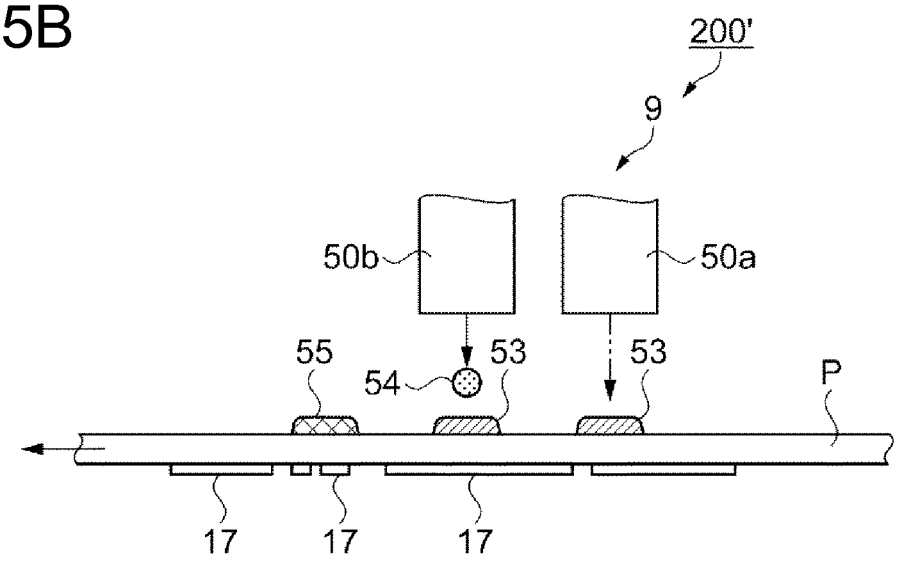

Another preferred embodiment of an adhesive label production device is described next. FIG. 5 (*a*) is a section view illustrating an example of an adhesive application method using the inkjet head of a printer according to a second embodiment of the invention. The printer (adhesive label production device) 200 according to the second embodiment of the invention differs from the printer 100 according to the first embodiment in the way that the adhesive is ejected onto the recording paper P by the inkjet head 50. As a result, parts in the configuration of this printer 200 that are equivalent to parts in printer 100 are identified by the same reference numerals, and primarily the parts that differ from the above printer 100 are described below.

As shown in FIG. 5 (*a*), the inkjet head 50 of the printer 200 has nozzles (ejection holes) 51 for ejecting a first functional fluid 53, and nozzles (ejection holes) 52 positioned downstream in the conveyance direction of the recording paper P from nozzles 51 for ejecting a second functional fluid 54. The first functional fluid 53 and second functional fluid 54 are not individually adhesive, but become adhesive when mixed together. The printer 200 uses functional acrylic fluids for the first functional fluid 53 and second functional fluid 54. Note that urethane resin, epoxy resin, or silicone resin, for example, can be used as the functional fluid instead of a functional acrylic fluid. In addition, the head surface where the nozzles 51, 52 are formed, and the surface of the recording paper P to which the functional fluid is applied, are disposed opposite and parallel to each other, but for convenience of description are not drawn parallel in FIG. 5 (*a*). In addition, the recording paper P is printed on one side and has adhesive 18 applied to the other side.

When the recording paper P is conveyed to the inkjet head 50 in this printer 200, the inkjet head 50 first ejects the first functional fluid 53 as droplets from the nozzles 51 onto the recording paper P. The ejected first functional fluid 53 lands on and adheres to the recording paper P, and is conveyed to directly below nozzles 52. The inkjet head 50 then ejects droplets of the second functional fluid 54 from the nozzles 52. The second functional fluid 54 is ejected covering the first functional fluid 53 already deposited on the recording paper P. As a result, the first functional fluid 53 and second functional fluid 54 mix together on the surface of the recording paper P, forming an adhesive 55 with adhesive properties. This adhesive 55 has substantially the same adhesive properties as the adhesive 18 in the first embodiment. The printer 200 can coat the entire surface of the recording paper P with adhesive 55 by carefully ejecting functional fluid from the inkjet head 50, and by the ejection control unit 31 adjusting the ejecting timing from the nozzles 51, 52, can freely control where the adhesive 55 is applied to the recording paper P.

Because the inkjet head 50 in this printer 200 ejects a first functional fluid 53 and a second functional fluid 54 that are not adhesive, ejection from inkjet nozzles 51, 52 is easier than directly ejecting adhesive 18 from the inkjet head 15 as in the first embodiment. In addition, because the first functional fluid 53 and second functional fluid 54 are not adhesive, the printer 200 can more easily clean the nozzles 51, 52 by wiping, and maintenance is simplified.

This printer 200 is configured to eject different functional fluids from nozzles 51, 52 in a single inkjet head 50, but a configuration with inkjet heads such as described below is also conceivable. FIG. 5 (*b*) is a section view showing another example of an adhesive application method using an inkjet head. As shown in FIG. 5 (*b*), this printer (adhesive label production device) 200' has an inkjet head 50*a* for ejecting the first functional fluid 53 onto the recording paper P, and an inkjet head 50*b* for ejecting the second functional fluid 54 at a position on the downstream side of the inkjet head 50*a* in the recording paper P conveyance direction. More specifically, inkjet head 50*a* and inkjet head 50*b* together are equivalent to the inkjet head 50 in printer 200.

When the recording paper P is conveyed to the inkjet head 50*a* in this printer 200', inkjet head 50*a* ejects droplets of the first functional fluid 53 onto the recording paper P. The ejected first functional fluid 53 lands on and adheres to the recording paper P, and is conveyed to directly below inkjet head 50*b*. This inkjet head 50*b* then ejects droplets of the second functional fluid 54. The second functional fluid 54 is ejected covering the first functional fluid 53 already deposited on the recording paper P. As a result, the first functional fluid 53 and second functional fluid 54 mix together on the surface of the recording paper P, forming an adhesive 55 with adhesive properties.

As thus described, the printer 200' has inkjet head 50*a* and inkjet head 50*b*, each ejecting a different type of functional fluid. As a result, the printer 200' can be controlled more easily than a printer 200 that ejects plural different functional fluids from a single inkjet head. When cleaning the nozzles 51, 52 by wiping, the printer 200' can also completely prevent different functional fluids from mixing.

Embodiment 3

Figure 6A:
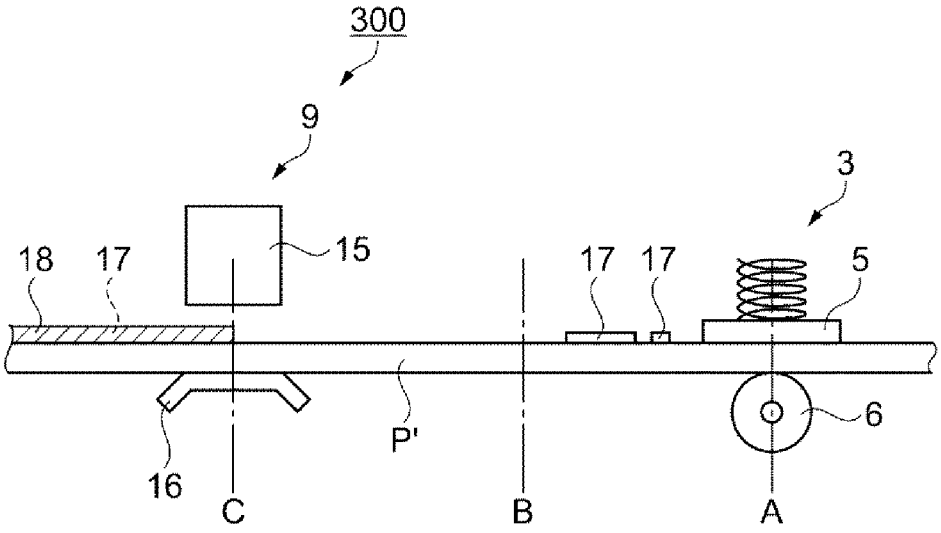
FIG. 6 (*a*) is a section view illustrating printing and adhesive application by a printer according to a third embodiment of the invention, and (b) illustrates an adhesive label according to a third embodiment of the invention.
Figure 6B:
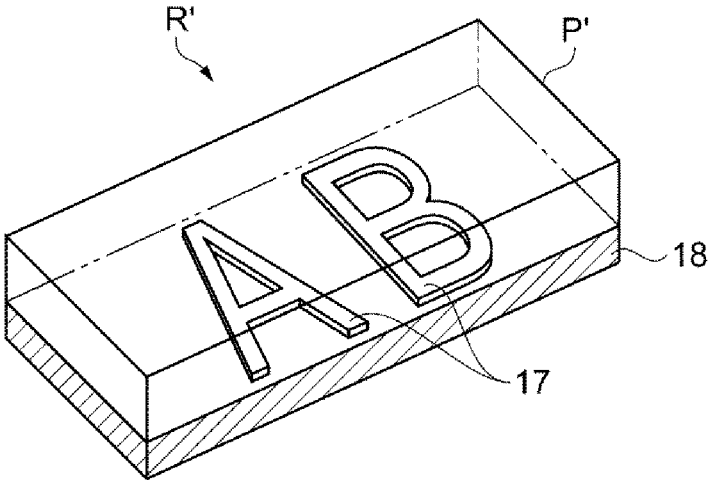

Another preferred embodiment of an adhesive label production device is described next. FIG. 6 (*a*) is a section view illustrating printing and adhesive application in a printer according to the third embodiment of the invention, and FIG. 6 (*b*) is an oblique view showing the appearance of an adhesive label according to the third embodiment of the invention. The printer 300 according to the third embodiment of the invention differs from the printers 100, 200, 200' according to the first embodiment and the second embodiment in the construction of the recording paper P', and the method of printing and ejecting adhesive on the recording paper P' by means of the recording head 5 or other ejection mechanism. As a result, parts in the configuration of this printer 300 that are equivalent to parts in printer 100, 200, or 200' are identified by the same reference numerals, and primarily the parts that differ from the above printers 100, 200, or 200' are described below.

As shown in FIG. 6 (*a*), the printer (adhesive label production device) 300 has a print mechanism 3 including a recording head 5 for printing on the recording paper P', and a platen roller 6 disposed opposite the recording head 5 to hold the recording paper P' therebetween with the recording head 5, and prints 17 on the recording paper P' at the print position A; an automatic cutter 4 (not shown in the figure) that cuts the recording paper P' with printed text 17 at the cutting position B; and an adhesive application mechanism 9 including an inkjet head 15 that ejects adhesive 18 onto the text 17 side of the recording paper P' at the adhesive application position C, and a platen 16 for guiding the recording paper P'.

In this configuration, as shown in FIG. 6 (*b*), the recording paper P' used in this printer 300 is a transparent recording medium with transparency, and the adhesive 18 is applied to the surface with the text 17 so that the text 17 is covered. As a result, the text 17 printed on the one side can be seen from the other side of the adhesive label R' that is produced.

This printer 300 thus prints the text 17 and applies the adhesive 18 to the same side of the recording paper P'. As a result, when the resulting adhesive label R' is affixed to an object, the text 17 is positioned between the recording paper P' and the item to which the adhesive label R' is applied. As a result, the text 17 can be seen after the adhesive label R' is affixed while the text 17 can also be prevented from disappearing due to scratches or rubbing.

The printers 100, 200, 200', 300 described above are not limited to the foregoing embodiments, and the same effect as described above can be achieved by variations such as described below.

Example 1

The foregoing printers 100, 200, 200', 300 are configured so that the inkjet head 15, 50, 50*a*, 50*b* used as the ejection mechanism ejects an adhesive 18 or a first functional fluid 53 and second functional fluid 54 that become an adhesive 55, but the invention is not so limited and the ejection mechanism could be configured with the ability to print in addition to the ability to eject an adhesive 18 or first functional fluid 53 and second functional fluid 54. For example, printer 300 is configured with the ejection mechanism having the function of the print mechanism 3. In a printer thus comprised, the ejection mechanism is configured to eject the adhesive 18 to cover the ink after printing by ejecting printing ink, for example. Alternatively, the ejection mechanism could be configured to eject a printing ink that is also adhesive, or the printer could be configured to eject an adhesive that can also substitute for a color printing ink. In printers with any of these configurations, a single inkjet head handles the functions of both the recording head 5 that prints on the recording paper P', and the ejection mechanism that ejects the adhesive 18 or first functional fluid 53 and second functional fluid 54. As a result, the printer comprises the automatic cutter 4 and an ejection mechanism, the conveyance mechanism can be simplified, and the size can be further reduced.

Example 2

The foregoing printers 100, 200, 200', 300 use a thermal head as the recording head 5, but a head other than a thermal head, such as an inkjet head, can be used. This configuration makes color printing simple.

Example 3

The recording paper P is described using plain paper for printing receipts as the recording medium, for example, but materials other than plain paper, such as film, can be used as the recording medium.

Example 4

The inkjet head 50 in printer 200 above is configured to eject two fluids, first functional fluid 53 and second functional fluid 54, but is not limited to two fluids and configurations that form an adhesive by ejecting three or more functional fluids are also conceivable. This configuration affords a wider selection of functional fluids.

Example 5

Configurations in which the inkjet heads 15, 50, 50*a*, 50*b* in the above printers 100, 200, 200', 300 can be removed from the printer are also conceivable. This enables using the printer in a smaller configuration when used only for printing on the recording paper P, P'.

REFERENCE SIGNS LIST

1*a* print unit
3 print mechanism
4 automatic cutter
5 recording head
9 adhesive application mechanism
11 drive roller
15 inkjet head as an ejection mechanism
17 print
18 adhesive
20 paper feed motor
30 control unit
40 host
50, 50*a*, 50*b* inkjet heads as ejection mechanisms
51, 52 nozzles as ejection holes
53 first functional fluid
54 second functional fluid
55 adhesive
100, 200, 200', 300 printer as an adhesive label production device
P recording paper as a recording medium
P' recording paper as a transparent recording medium

The invention claimed is:

1. An adhesive label production device comprising:

a conveyance mechanism that conveys a continuous recording medium;

a recording head that prints text on the continuous recording medium conveyed by the conveyance mechanism; and an ejection mechanism that ejects adhesive onto the continuous recording medium after printing by the recording head, the ejection mechanism including a plurality of ejection holes and able to individually control ejection from each of the ejection holes, wherein:

the ejection mechanism is an inkjet type ejection mechanism, and wherein the inkjet type ejection mechanism comprises a plurality of nozzles for ejecting droplets of adhesive, and the inkjet type ejection mechanism is configured to apply the droplets of adhesive to the continuous recording medium by selection of which of the nozzles eject the droplets of adhesive and selection of an ejection timing of said droplets from the nozzles to deposit the droplets of adhesive in a predetermined pattern.

2. The adhesive label production device described in claim 1, further comprising:

an automatic cutter that cuts the recording medium;

the ejection mechanism ejecting adhesive on to the continuous recording medium after cutting by the automatic cutter.

3. The adhesive label production device described in claim 1, wherein:

the ejection mechanism can eject the adhesive in a desired pattern on the opposite side of the continuous recording medium as the side that was printed.

4. The adhesive label production device described in claim 1, wherein:

the ejection mechanism ejects a plurality of functional fluids that when mixed exhibit the same adhesion as the adhesive.

5. The adhesive label production device described in claim 4, wherein:

the adhesive label production device has plural ejection mechanisms, and each ejection mechanism ejects one of plural functional fluids.

6. The adhesive label production device described in claim 1, wherein:

both printing and application of adhesive are applied to one side of the continuous recording medium.

7. The adhesive label production device described in claim 6, wherein:

in addition to the ability to eject adhesive, the ejection mechanism also has the ability to print text on the continuous recording medium instead of the printhead, and is disposed facing the one side of the continuous recording medium.

* * * * *